US006052933A

United States Patent [19]

Lytle

[11] Patent Number: 6,052,933

[45] Date of Patent: Apr. 25, 2000

[54] PICTURE FRAMING SYSTEM

[76] Inventor: David B. Lytle, 372 N. Pike Rd., Cabot, Pa. 16023

[21] Appl. No.: 08/863,456

[22] Filed: May 27, 1997

[51] Int. Cl.[7] ..... A47G 1/06

[52] U.S. Cl. ..... 40/711; 40/594; 40/600; 40/654.01; 40/661.01; 40/661.09; 40/765; 40/771; 40/773; 40/768; 248/683

[58] Field of Search ..... 40/594, 600, 654.01, 40/661.01, 661.09, 711, 765, 771, 773, 776, 768, 595; 248/206.5, 683

[56] References Cited

U.S. PATENT DOCUMENTS

| | | | |
|---|---|---|---|
| 2,921,765 | 1/1960 | Eggert | 248/206.5 |
| 2,925,675 | 2/1960 | Lumpkin | 40/776 X |
| 3,187,449 | 6/1965 | Longo et al. | 40/600 X |
| 3,237,327 | 3/1966 | Griggs . | |
| 3,314,634 | 4/1967 | Carter | 248/683 |
| 3,797,147 | 3/1974 | Lemberg | 40/104.19 |
| 3,826,026 | 7/1974 | Bevan | 40/600 X |
| 4,236,331 | 12/1980 | Mattson . | |
| 4,250,640 | 2/1981 | Culhane | 40/776 |
| 4,605,292 | 8/1986 | McIntosh | 248/206.5 X |
| 4,771,557 | 9/1988 | Bowman | 40/594 X |
| 4,785,562 | 11/1988 | Good . | |
| 4,875,654 | 10/1989 | Chandonnet et al. | 248/206.5 X |
| 4,896,027 | 1/1990 | Drexler | 40/771 X |
| 4,900,392 | 2/1990 | Bradshaw et al. | 156/541 |
| 4,918,848 | 4/1990 | Stein | 40/600 X |
| 4,991,330 | 2/1991 | Heidari | 40/158.1 |
| 5,075,991 | 12/1991 | Wenkman et al. | 40/781 |
| 5,245,775 | 9/1993 | Goserud | 40/654.01 |
| 5,246,253 | 9/1993 | Mykrantz | 283/117 |
| 5,269,083 | 12/1993 | Vampatella et al. | 248/206.5 X |
| 5,309,659 | 5/1994 | Eastman . | |

FOREIGN PATENT DOCUMENTS

| | | | |
|---|---|---|---|
| 2415988 | 10/1979 | France | 40/594 |

*Primary Examiner*—Terry Lee Melius
*Assistant Examiner*—Andrea Chop
*Attorney, Agent, or Firm*—George C. Atwell

[57] ABSTRACT

A picture framing system is disclosed for mounting, displaying and protecting a photograph or work of art on a vertical surface of ferrous metal, non-ferrous metal, or a non-metallic surface without using nails. The picture framing system includes a sleeve or pocket-type photograph holder which can be used with various styles of mats and picture frames for mounting, displaying, and protecting the photograph against the flat vertical surface, such as a refrigerator door or dining room wall. The picture framing system includes a flexible sheet having an adhesive front surface for attachment to the photograph holder and a magnetized rear surface for permitting the attachment of either type of photograph holder to a ferrous metal surface. The picture framing system also includes a flat, flexible ferro-magnetic sheet having a front magnetically-attractive surface and a rear adhesive surface for allowing either type of photograph holder and the picture frame to be mounted on a non-ferrous metal surface or any non-metallic surface. In addition, the picture framing system includes a centering tool for centering the photograph or art work on the mat and within the sleeve or pocket-type photograph holder and also within the picture frame.

3 Claims, 5 Drawing Sheets

12
48
50
56
60
58
14
22
34
38
16
52
54
62

PICTURE FRAMING SYSTEM

BACKGROUND OF THE INVENTION

The present invention relates generally to framing systems and, more particularly, pertains to a picture framing system which includes a variety of photo holders to mount photographs to ferrous metal, non-ferrous metal, and non-metallic surfaces.

It is a common practice in homes, offices, public and private facilities and institutions, to mount photographs covering every conceivable subject on walls and other surfaces, by using a variety of framing, holding, and hanging structures. In addition to mounting photographs on walls, photographs are also mounted on desks, filing cabinets, shelves, kitchen cabinets, and refrigerators. Mounting photographs on refrigerators with kitchen magnets has become popular in recent years as the kitchen refrigerator has also become the repository for notes, messages, announcements, artistic works, and athletic and academic awards and honors. It is a common practice for businesses to give away kitchen magnets which can be used to mount photographs or other items to the refrigerator as a promotional item for their products and/or services.

Moreover, to protect the photograph and enhance its visual appeal, a number of picture frames and holders are available. One type of photo holder for mounting photographs is disclosed in Eastman's U.S. Pat. No. 5,309,659. Eastman discloses a generally planar transparent sheet with upper and lower lips for receiving and holding therein a photograph. A sheet of magnetic material is also disposed within the lips of the transparent sheet behind the photograph for enclosing and holding the photograph between the magnetic sheet and the transparent sheet. However, Eastman's frame can only be attached to ferrous metal surfaces, and Eastman does not disclose any kind of sleeve, pocket, or picture frame for mounting the photograph. Also, Eastman does not disclose the use of any kind of mat (a top mount mat or floating mat) for framing and visually enhancing the mounting of the photograph. Furthermore, Eastman does not disclose a framing system which includes a centering tool for centering the photograph upon the mat and within the sleeve, pocket, or frame so that the photograph is properly positioned for creating maximum visual appeal.

SUMMARY OF THE INVENTION

The present invention comprehends a picture framing system for mounting photographs and works of art to any ferrous metal, non-ferrous metal, and non-metallic surface, and incorporates a sleeve, pocket or picture frame, used in conjunction with several different types of mats, for holding, protecting, and framing the photograph therein and then magnetically mounting the entire system to any type of surface.

The framing system includes a photo or art holder in the form of a sleeve or pocket-type design which can be mounted to any ferrous metal, non-ferrous metal, or non-metallic surface. The photo holder includes two transparent sheets attached together by a spacer or separator strip which is interposed between the sheets and to which the sheets are affixed. Interposition of the spacer between the sheets creates a pocket for receiving and holding therein the photograph or work of art. The photo holder can be mounted to a ferrous metal surface by using a flat, magnetic sheet having a magnetized rear surface for adherence to the ferrous metal surface; or the photo holder can be mounted to a non-ferrous metal surface or a non-metallic surface by first attaching the ferromagnetic sheet to the non-ferrous metal or non-metallic surface, and then attaching the magnetic sheet to the ferromagnetic sheet.

An alternative embodiment for the framing system includes a picture frame having a continuous channel formed on its back side so that the photo holder, with the photograph contained therein, can be set within the channel. The flat, magnetic sheet is adhered to the rear of the photo holder, and the opposite magnetized rear surface of the magnetic sheet will magnetically attach directly to the ferrous metal surface. The flat, ferromagnetic sheet can be adhered to any clean dry surface or any non-ferrous metal or non-metallic surface, so that the complete unit, including the picture frame and photo holder, can be mounted magnetically upon the ferromagnetic sheet.

A second alternative embodiment for the framing system includes a U-shaped, flexible, transparent centering tool and a top mount mat or floating mat. The centering tool has grid lines and indicia printed on its front work surface. The picture framer first centers the mat under the centering tool using the sides or border of the tool if the mat is the same size as the tool, or by using the numbers and grid lines if the tool is larger than the mat. Once the photograph or work of art is centered within the borders of the centering tool, and also within the borders of the mat upon which the centering tool temporarily lays, the photograph or work of art can be adhered to the facing surface of the mat and the centering tool can be easily removed by sliding it out.

It is an objective of the present invention to provide a framing system which incorporates a number of different photo holders, in the form of sleeves, pockets, or picture frames, and various types of mats for protecting and mounting photographs to ferrous metal, non-ferrous metal, and non-metallic surfaces.

It is another objective of the present invention to provide a centering tool for centering photographs on the mats in order to enhance the visual appeal of the photographs.

These together with other objects and advantages which will become subsequently apparent reside in the details of construction and operation as more fully hereinafter described and claimed, reference being had to the accompanying drawings, forming a part hereof, wherein the numerals refer to like parts throughout.

DETAILED DESCRIPTION OF THE PREFERRED EMBODIMENT

Illustrated in FIGS. 1–10 is a picture framing system which uses a variety of structural elements or pieces to frame and mount a planar object, such as a photograph or work of art, or both, on ferrous metal, non-ferrous metal, and any other non-metallic surface. The picture framing system incorporates various types of photograph holders for receiving and holding a photograph or work of art therein, several different types of mats to provide a border and support for the photograph or work of art as they are held within the photograph holder, and a mounting means for securing the photograph holder containing the photo and/or work of art to either ferrous metal, non-ferrous metal, or non-metallic surfaces.

Photograph and art holders come in a variety of sleeve and pocket-type designs, and picture frames run the gamut from simple, inexpensive, injection-molded frames to intricately carved, ornate wooden frames. Matting is the border that goes around a photograph, and mats come in everything from a simple sheet of colored paper or paperboard to fine suedes and linens, and can be used singly or in layers. Mats can also be decorative, with styles varying from drawn and painted accents to cut-outs. In addition, there are also mat liners, called "filets", for use between the artwork and the mat in order to produce a more vivid contrast. To properly frame and mount a photograph or artwork in order to create the maximum visual appeal for viewers, careful consideration must be given to the choice of mats, photo or art holders, and picture frames.

Figure 1:
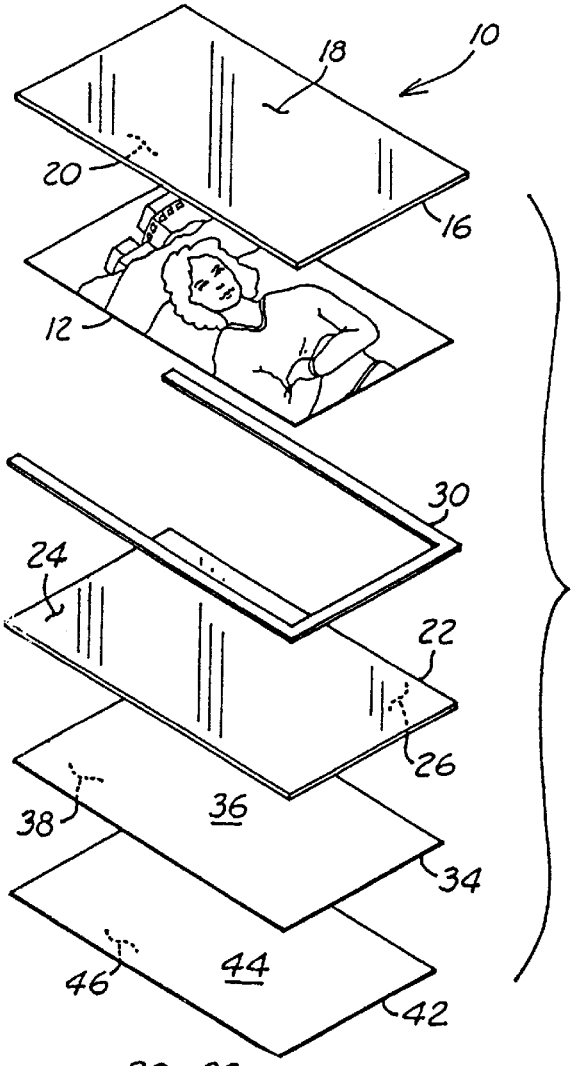
FIG. 1 is an exploded view of the various components of the preferred embodiment of the picture framing system.
Figure 2:
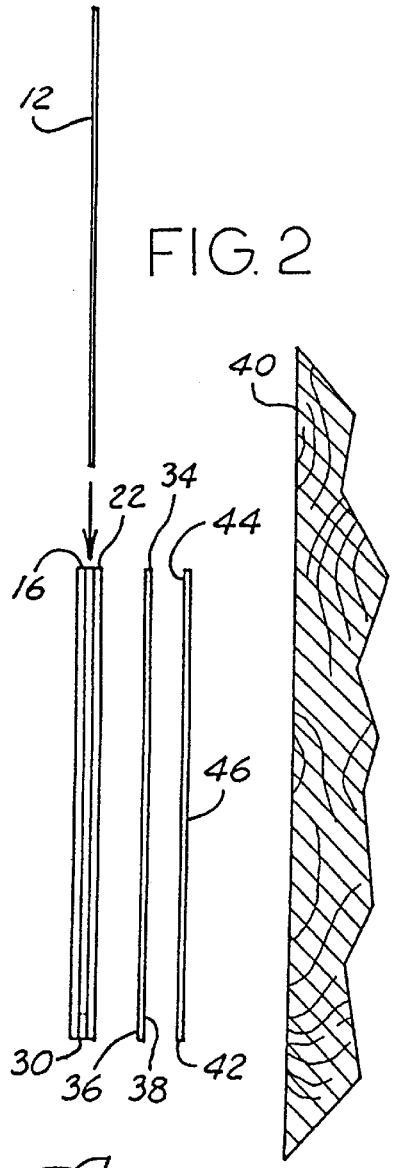
FIG. 2 is a side elevational view of the picture framing system first shown in FIG. 1 being mounted to a non-metallic surface.
Figure 3:
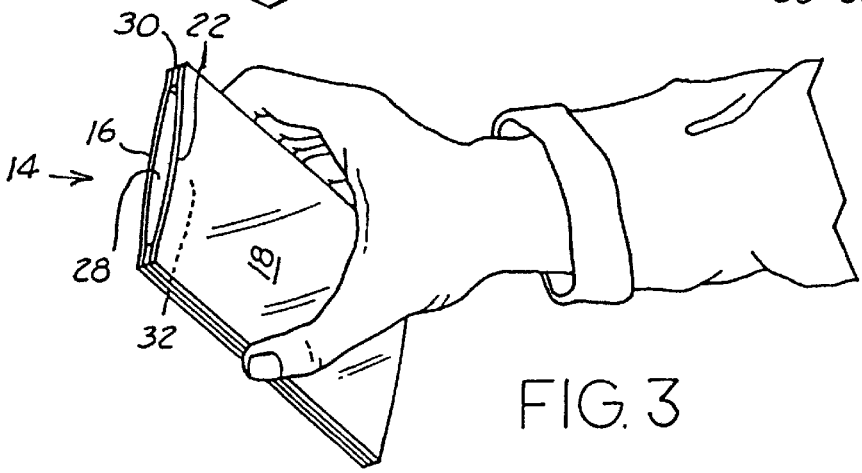
FIG. 3 is a perspective view of the picture framing system first shown in FIG. 1.

As shown in FIGS. 1–10, the present invention comprises a framing system which includes a photograph or art holder, a mat, or several mats, and a means to center the photograph upon the mat and within the borders of the photo holder. Illustrated is FIGS. 1–3 is a framing system 10 which is readily adaptable to mount a planar object, such as a photograph 12, on either ferrous metal, non-ferrous metal, or non-metallic surfaces. The framing system 10 shown in FIGS. 1–3 includes a photograph or art holder 14 and a photo holding means in the form of a first flat, transparent, parallelogram-shaped sheet 16 which has a flat, front surface 18 and an opposite flat, rear surface 20. Disposed parallel to and behind the sheet 16 is a second flat, transparent, parallelogram-shaped rear sheet 22 which includes a facing surface 24 and an opposite backing surface 26. The sheets 16 and 22 should be of the same size, and can be square or rectangular-shaped. The sheets 16 and 22 are disposed in a parallel, spaced-apart relationship with respect to each other, and can be manufactured from a clear flexible plastic material or a semi-rigid vinyl plastic material. When the sheets 16 and 22 are attached together they create a peripheral border having at least one opening 28 for allowing insertion therethrough of the photograph 12 or work or art.

A spacer or separator means is used to attach the sheet 16 to the sheet 22 in order to create the sleeve or pocket-type photo or art holder 14 shown in FIGS. 1–3. The spacer means for attaching the sheets 16 and 22 to each other includes a separator strip or spacer 30 which is interposed between, and affixed to, the sheets 16 and 22. Specifically, the spacer 30 has a U shape and can be manufactured from the same plastic material as the sheets 16 and 22. The spacer 30 is disposed between the sheets 16 and 22 and extends continuously along the peripheral edges of two sides, and preferably three sides, of the sheets 16 and 22. The spacer 30 is welded or glued to the rear surface 20 of the sheet 16 and the facing surface 24 of the sheet 22. By interposing the spacer 30 between the sheets 16 and 22, and then adhering the sheets 16 and 22 to the spacer 30, the sheets 16 and 22 are disposed in spaced, parallel relationship to one another, and a pocket 32 is formed between the sheets 16 and 22 wherein the photograph 12 or work of art can be received and held for permanent mounting. The one peripheral edge of the sheets 16 and 22 which does not have the spacer 30 interposed therebetween provides the opening 28 for the photo holder 14. If the sheets 16 and 22 are sealed along their long edges, then two openings 28 are formed on the short sides of the sheets 16 and 22. Thus, the use of the spacer 30 of FIG. 1 seals the sheets 16 and 22 along three sides and yet allows one side, perferably one of the short sides, of the sheets 16 and 22 to remain open for allowing insertion of the photograph 12, and, if desired, a mat or several mats.

In order to mount the photo holder 14 to a ferrous metal surface, which may be a refrigerator door, a flat, parallelogram-shaped magnetic sheet 34 is used. The magnetic sheet 34 is a thin sheet of rubber with fine ferrous metal powder embedded within the sheet 34. The fine ferrous metal powder is then magnetized by passing the sheet 34 in close proximity to an electrical field. The sheet 34 has an adhesive front surface 36 (a self-adhesive surface) which can be affixed to the backing surface 26 of the sheet 22. The adhesive surface 36 may be covered by a piece of peel-away siliconized paper that can easily be removed before adherence of the backing surface 26 to the photo holder 14. An opposite magnetized rear surface 38 of the sheet 34 can then be placed against the ferrous metal surface of the refrigerator door for securement thereto. Thus, the photo holder 14 with the photograph 12 or work of art received within the pocket 32 and held between the sheets 16 and 22 can be mounted as a unit to the surface of the refrigerator door by using only the magnetic sheet 34.

Should the individual desire to mount the photo holder 14 to a non-ferrous metal or a non-metal surface, such as dining room wall 40 of FIG. 2, the framing system 10 shown in FIGS. 1–3 also includes a flat, parallelogram-shaped ferromagnetic sheet 42 (also referred to as "ferro-sheet") which has a front magnetically-attractive surface 44 and an opposite rear self-adhesive surface 46. The self-adhesive surface 46 permits removable attachment of the sheet 42 to both non-ferrous metal and non-metal surfaces. The sheet 42 is a thin sheet of rubber with fine ferrous metal powder intermixed and embedded within the sheet 42. The rear surface 46 of the sheet 42 has a self-adhesive material, such as glue, coated or applied thereto and which is easily exposed by peeling away a thin siliconized paper covering, thus allowing the sheet 42 to be adhereed with light pressure to any clean, dry surface. Thus, as shown in FIG. 1, the photo holder 14 will be assembled with the sheet 16 facing the prospective viewers, the spacer 30 disposed behind the sheet 16 for adhesion to the surface 20 of the sheet 16 and the surface 24 of the sheet 22 thereby forming the pocket 32 for receiving and holding therein the photograph 12. The adhesive surface 36 of the sheet 34 will be adhered to the surface 26 of the plastic sheet 22. The magnetically-attractive surface 44 of the sheet 42 will have the siliconized paper peeled away from the rear surface 46 so that the sheet 42 can have its adhesive rear surface 46 exposed for securement to the non-ferrous surface or non-metal surface, such as the wall 40 or window. The photo holder 14 can then be mounted magnetically to the sheet 42 by pressing the rear magnetic surface 38 of the sheet 34 to the magnetically-attractive surface 44 of the sheet 42.

FIG. 2 also shows the order in which the elements of the photo holder 14 are assembled with the photograph 12 slidably receivable into the pocket 32 from above the photo holder 14. Depending on the size and shape of the photograph 12 and/or work of art, the photo holder 14 can be mounted so that the pocket 32 is on the left or right side, or opening at the top, for allowing the photograph 12 and work of art to be slid therein. It should be noted that the portion of the spacer 30 which both defines and extends along the short side of the peripheral border of the sheets 16 and 22 also serves as the base upon which the photograph 12 rests, thereby preventing the photograph 12 from sliding through the opening 28 of pocket 32 and falling onto the floor when the photo holder 14 is disposed as shown in FIG. 2. Moreover, one or several mats can also be disposed within the pocket 32 for placement behind the photograph 12 to provide a visually appealing and enhancing border for the photograph 12 and/or work of art.

Illustrated in FIGS. 4–7 is an alternative preferred embodiment for a picture framing system for mounting planar objects, such as photographs, to ferrous metal, non-ferrous metal, and non-metallic surfaces. In the picture framing system 48 of FIGS. 4–7, the photo or art holder is in the form of a three-dimensional picture frame 50, preferably manufactured from either plastic or wood, and which is removably attachable to the above surfaces. The frame 50 has a front side 52, an opposite back side 54, and is parallelogram-shaped for defining an aperture 56 through which the photograph 12 and work of art can be viewed; although the frame 50 could be formed into a number of different geometric shapes. The frame 50 is routed out so that the photo holder 14 shown in FIGS. 1–3 can be placed and held within the frame 50. Specifically, the back side 54 defines an inner periphery which will support and border the different kinds of photo holders disposed therein, including the photo holder 14 shown in FIGS. 1–3. A continuous channel 58 is routed or formed from the inner periphery and forms one continuous step having a flat receiving surface on the back side 54. The photo holder 14 illustrated in FIGS. 1–3 is sized in order to fit within the channel 58.

Figure 4:
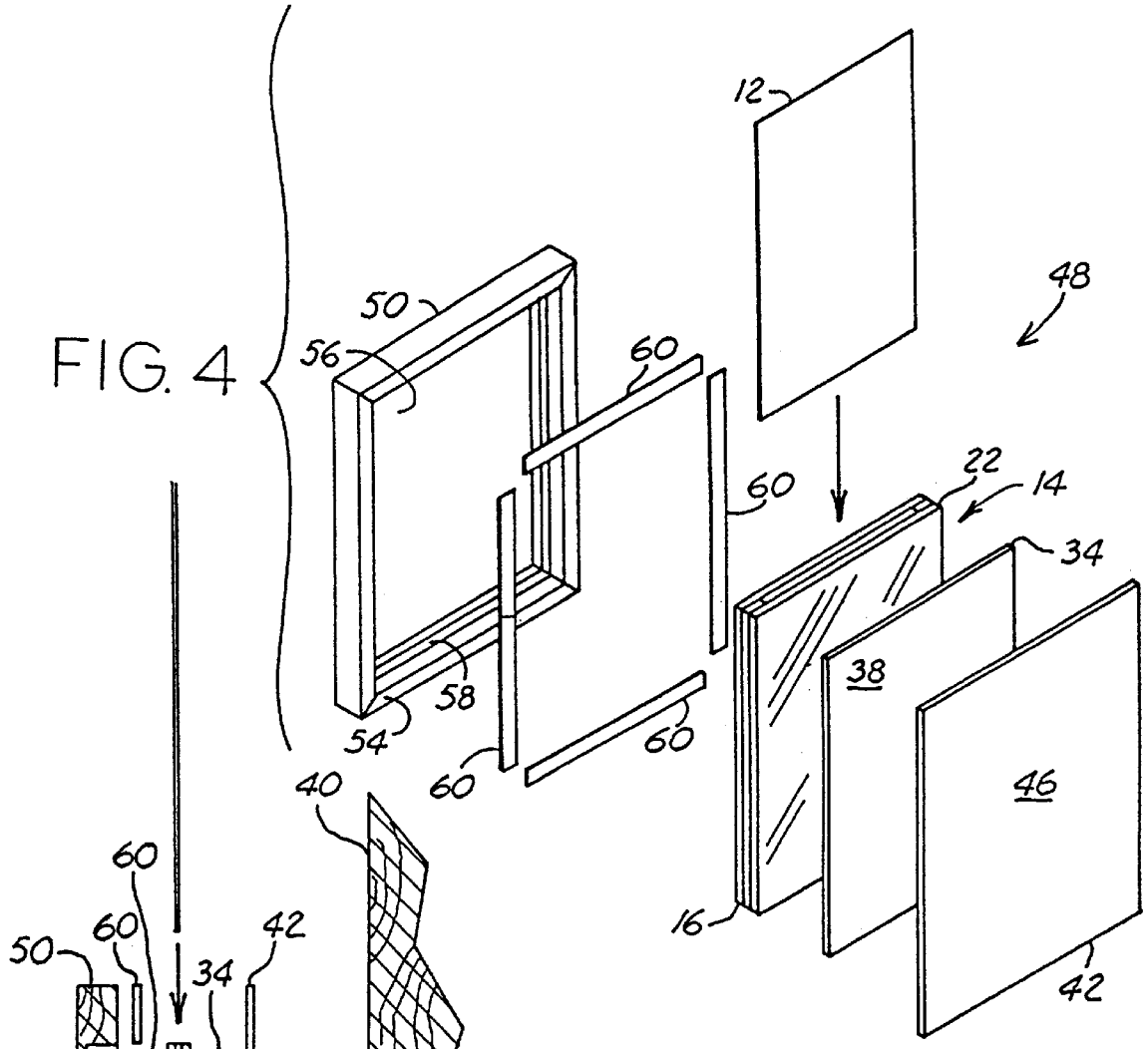
FIG. 4 is an exploded view of the various components of a first alternative preferred embodiment of the picture framing system.
Figure 5:
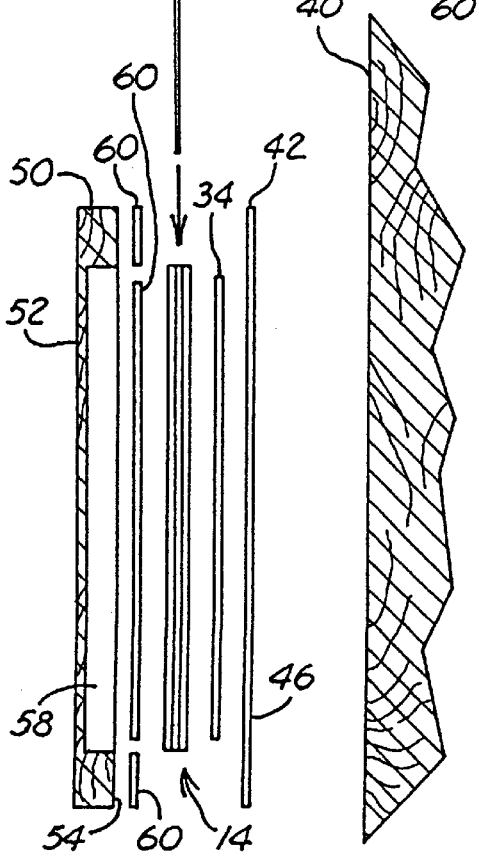
FIG. 5 is a side elevational view of the picture framing system first shown in FIG. 4 illustrating the use of a plurality of elongated strips for mounting the picture framing system to a non-metallic surface.
Figures 6, 7:
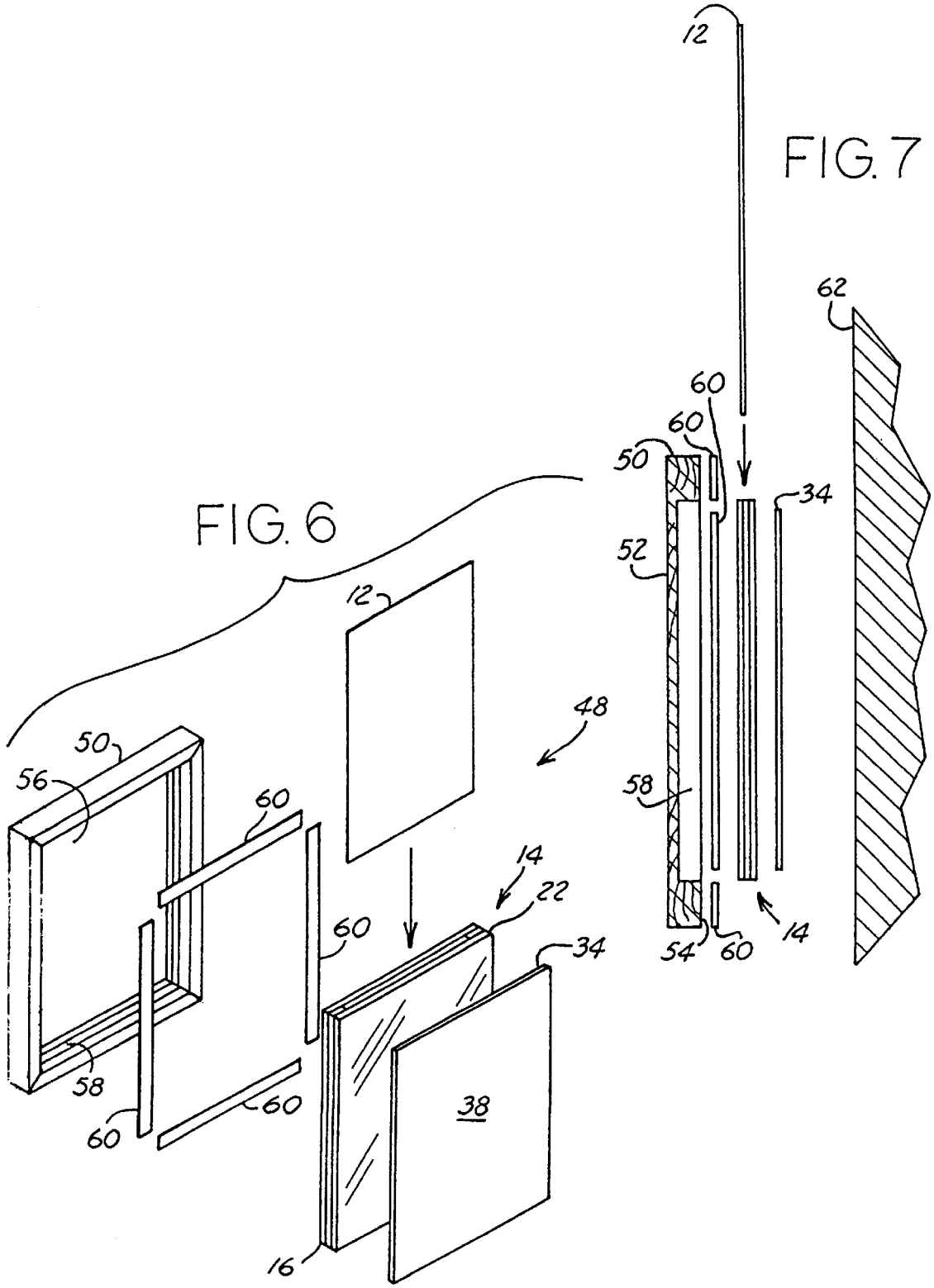
FIG. 6 is an exploded view of the picture framing system first shown in FIG. 4 illustrating the use of the strips and the magnetic sheet for mounting the picture framing system to a ferrous surface.
FIG. 7 is a side elevational view of a picture framing system first shown in FIG. 6 illustrating the attachment of the picture framing system to a ferrous metal surface, such as a refrigerator door.

Like the photo holder 14 of FIGS. 1–3, the frame 50 shown in FIGS. 4–7 can be mounted to either a ferrous metal, non-ferrous metal or a non-metallic surface. As shown in FIG. 5, the frame 50 can include four flat, elongated, magnetic strips 60 which are removably attachable to the back side 54 of the frame 50. Each strip 60 includes a self-adhesive front side for removable attachment to the back side 54 of the frame 50 and an opposite magnetized rear surface for removable attachment to a ferrous metal surface or to the magnetically attractive front surface 44 of the sheet 42.

As shown in FIGS. 4–7, the photo holder 14 of FIGS. 1–3 is placed within the frame 50 so that the peripheral edge or border of the sheets 16 and 22 is contained and held within the channel 58. The photograph 12, work of art, and a mat or mats, if so desired, will already have been inserted into the pocket 32. The strips 60 will have been affixed to the flat surface of the back side 54 of the frame 50. If the individual desires that the frame 50, the photo holder 14, and the photograph 12 and/or work of art retained within the photo holder 14 are to be mounted to a ferrous metal surface, such as the refrigerator door 62 of FIG. 7, the individual can simply first press the magnetized rear surface 38 of sheet 34 against the ferrous metal front surface of the door 62 for mounting the photo holder 14 and sheet 34 thereon. Then the individual can place the frame 50 over and around the photo holder 14 and, by pressing the strips 60 attached to the back side 54 of frame 50 against the ferrous metal surface of the door 62, mount the frame 50 to the refrigerator door 62.

As shown in FIGS. 4–7, the magnetic sheet 34 used in this embodiment is cut and sized so that it has the same dimensions as, or is slightly smaller than, the photo holder 14. If the individual desires to attach the photo holder 14, containing the photograph 12 and any mat or mats, and the frame 50, to a non-metal surface, such as wood, plastic or glass, all that is needed is to peel away the protective siliconized paper from the rear surface 46 of the sheet 42 so that the sheet 42 can be adhered by the self-adhesive rear surface 46 to any clean dry surface. The photo holder 14 can then be mounted to the magnetically-attractive surface 44 of sheet 42 by gently pressing magnetized rear surface 38 of sheet 34 there against. The frame 50 can then be secured to surface 44 of sheet 42 by gently pressing the strips 60 against surface 44 so that the frame 50 surrounds the photo holder 14 and gives a traditional framed appearance to the photograph 12 or work of art.

Figure 8:
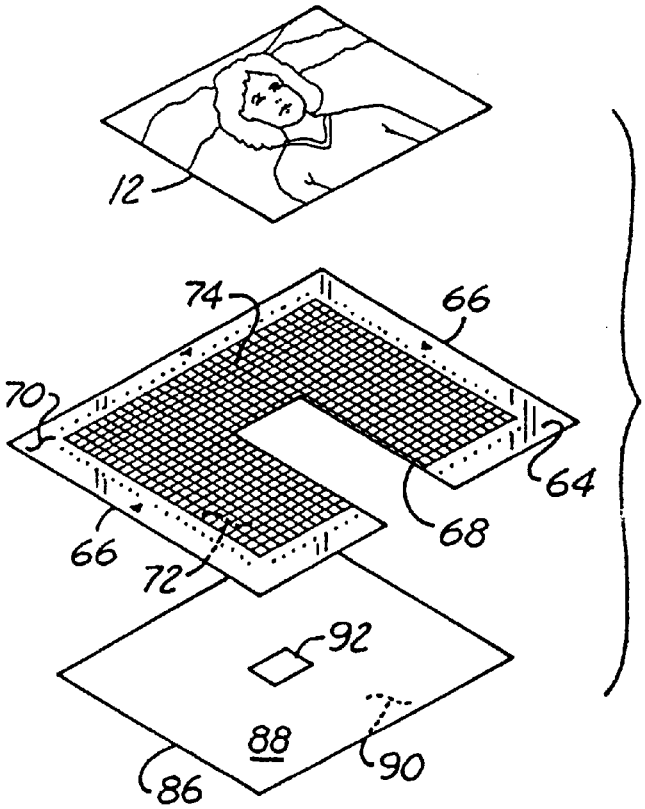
FIG. 8 is an exploded view of a photograph being centered on a top mount mat by using a centering tool.
Figure 9:
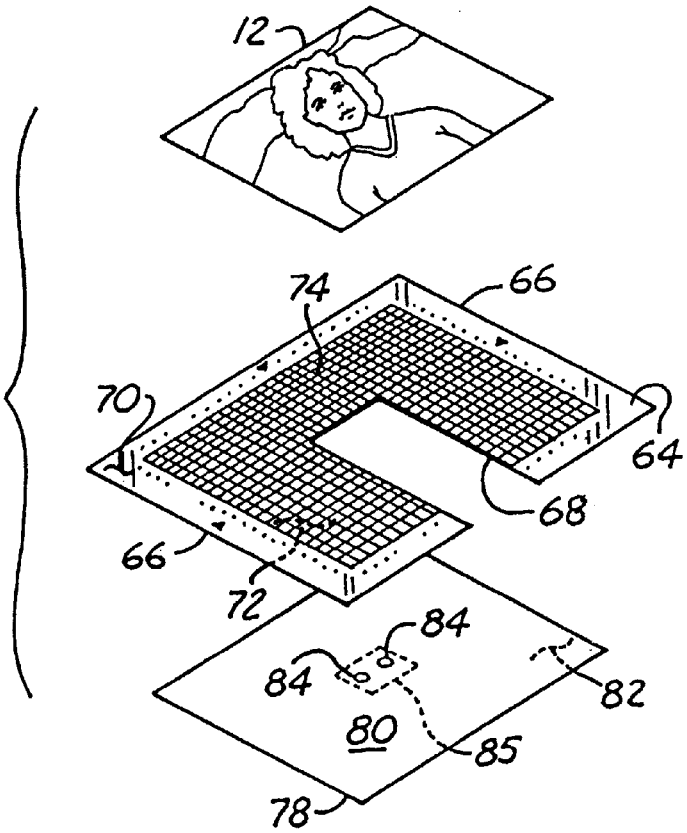
FIG. 9 is an exploded view illustrating the centering of a photograph on a mat having a plurality of apertures by using the centering tool first shown in FIG. 8.
Figure 10:
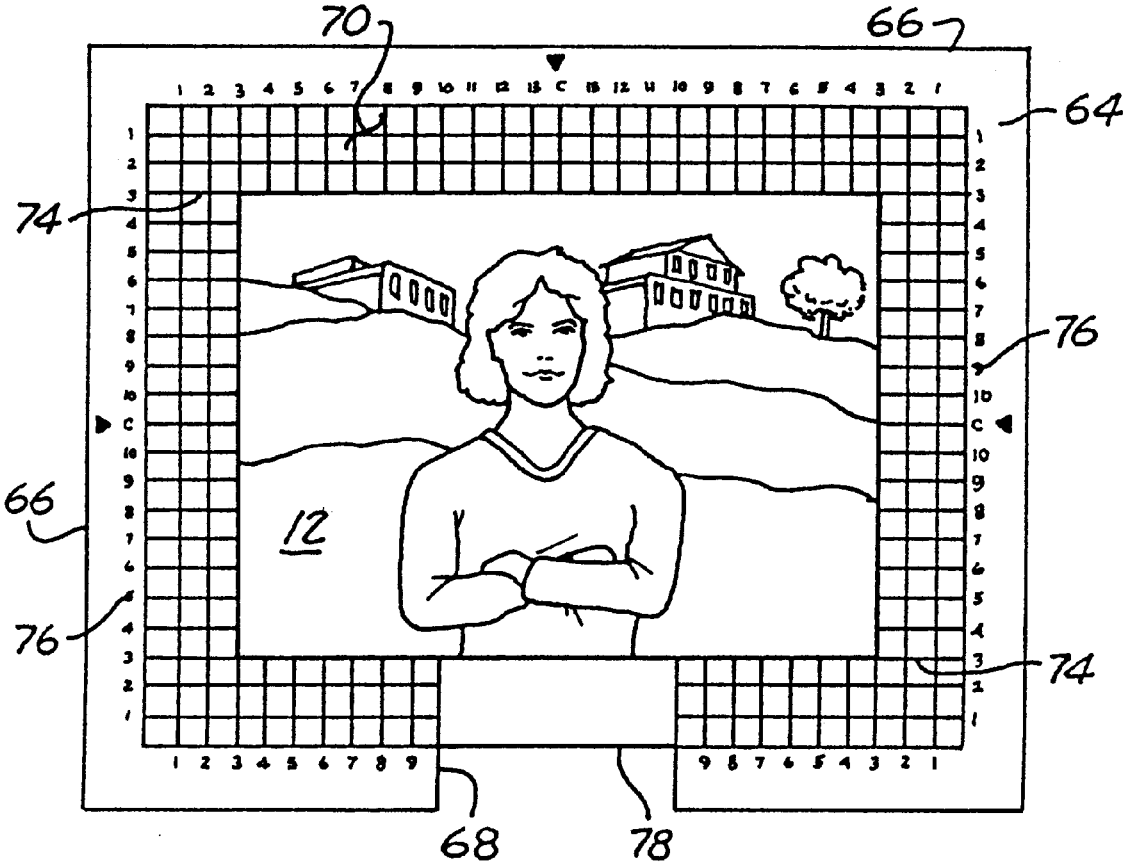
FIG. 10 is a front elevational view of the photograph laid upon the centering tool.

As shown in FIGS. 8–10, a means to center a photograph or work of art on a mat, such as a top mount mat or a top mount floating mat, is disclosed. The means for centering the photograph can be used with the framing system shown in FIGS. 1–3, and also with the framing system shown in FIGS. 4–7. The means for centering a photograph includes a specially designed tool, referred to as a "centering tool" 64. The centering tool 64 is a flexible, clear plastic or paper U-shaped element which defines a continuous peripheral border 66 and a center slot or cut-out 68. The centering tool 64 has a front work surface 70 and an opposite rear surface 72, and grid lines 74 and indicia 76, in the form of numbers, are included on the work surface 70. The framing systems shown in FIGS. 1–7 used in conjunction with the centering tool 64 include a top mount or floating top mount mat 78 which has a front surface 80, an opposite rear surface 82, and at least one, or preferably two, centrally-located apertures 84. In addition, a means of adhesion in the form of a strip of adhesive tape 85 is attached to rear surface 82 under apertures 84 so that the adhesive surface of the tape 85 can come into contact with the photograph 12 when the photograph 12 is pressed onto surface 80. The apertures 84 are positioned on the mat 78 so they fit within the cut-out 68 and are not covered by the tool 64. The mat 78 can be of a variety of colors, designs, and materials.

In addition, the framing system of FIGS. 8–10 also includes a top mount mat 86 having a facing surface 88, an opposite rear surface 90, and a means of adhesion in the form of at least one double-faced adhesive square or strip 92 attached to the surface 88. The strip 92 will have a self-adhesive facing side or surface and an adhesive rear or backing side which is pressed against the surface 88 of mat 86 for adhering the strip 92 thereto. The strip 92 should be located on the mat 86 so that the strip 92 is centered on mat surface 88 so that strip 92 will fit within cut-out 68 of tool 64. It should be noted that when centering and framing photograph 12, the individual can use either mat 78 or mat 86, but not both mats 78 and 86 together.

The following steps can be followed for centering the photograph 12 or work of art on the mats 78 or 86 using the centering tool 64. The procedure or method hereinafter described will generally produce the best results for centering the photograph 12 or work of art on the mat 78 or 86, although the steps of the procedure may be varied. When using mat 86, the first step is to peel the protective siliconized paper from the strip 92 of adhesive on the front surface 88 of the mat 86, exposing the adhesive substance on the upper or facing side of the adhesive strip 92. The centering tool 64 should now be placed in a face-up position over and laying upon the top or facing surface 88 of the mat 86. The center section of the centering tool 64 has been cut out beforehand to form the center slot or cut-out 68, thus allowing access to the adhesive of the strip 92 through the cut-out 68 of the centering tool 64 and to prevent the centering tool 64 from becoming accidentally attached to the mat 86. Next, align the border 66 of the centering tool 64 with the edges of mat 86 if the dimensions of mat 86 are the same as the peripheral border 66 of the centering tool 64. If mat 86 is smaller than the centering tool 64, the grid lines 74 and numbers 76 should be used to center mat 86 under the centering tool 64. The next step is to gently lay the photograph 12 or work of art on top of the facing work surface 70 of the centering tool 64 and, using the grid pattern 74 and numbered indicia 76 on the centering tool 64, center the photograph 12 or work of art. This will produce a balanced and symmetric positioning of the photograph 12 or work of art; although a more visually harmonious centering of the photograph 12 or work of art may be achieved by allowing slightly more space between the bottom edge of the photograph 12 and the bottom peripheral edge of mat 86 than between the top peripheral edge of the photograph 12 or work of art and the upper edge of mat 86. The final step in centering the photograph 12 or work of art is to apply light pressure to the central area of the photograph 12 or work of art to adhere the photograph 12 or work of art to the adhesive strip 92 or 85 depending on which type of mat and adhesion method are employed, and slide the centering tool 64 from its disposition between the photograph 12 or work of art and the mat 86 or 78. The top mounted photograph 12 or work of art with mat 78 or 86 is then ready to slip into the clear plastic photo or art holder 14.

The photograph 12 or work of art with its mat 78 or 86 can be disposed within the pocket 32 of photo holder 14 as shown in FIGS. 1–3 for mounting upon a ferrous metal surface, a non-ferrous metal surface, or any other clean, dry non-metallic surface, or the photograph 12 or work of art along with mat 78 or 86 can be disposed within the photo or art holder 14 for mounting with the frame 50 of FIGS. 4–5. Thus, there is an interchangeability and an adaptability between the framing components of the present invention so that the picture framing system can be magnetically mounted to any type of surface.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A framing system for centering and mounting a photograph on a flat, vertically-extending, non-ferrous metallic surface and a flat, vertically-extending, non-metallic surface, the framing system comprising:

a top mount mat having a front surfaces, an opposite rear surface, and at least one centrally-located aperture;

adhesion means for attachment to the rear surface so that the aperture is covered from the rear surface;

a flat, U-shaped centering tool having a front work surface, an opposite rear surface, grid lines extending on the front work surface, and indicia peripherally arranged about the grid lines and on the front work surface so that the centering tool can be temporarily laid upon the front surface of the top mount mat for superposing the photograph on the front work surface of the centering tool for centering the photograph over the aperture and against said adhesion means;

a photograph holder having opposed flat sheets attached to each other along three edges so that at least one opening is formed for enabling both the mat and the photograph to be inserted through the opening and into the holder;

a flat, magnetic sheet having an adhesive front surface for attachment to one of the flat sheets of the photograph holder and an opposite magnetized rear surface; and a flat, ferromagnetic sheet having a front magnetically attractive surface for attachment to the magnetized rear surface of the magnetic sheet and an opposite rear adhesive surface for removable securement to the non-ferrous metallic surface and the non-metallic surface.

2. A framing system for centering and mounting a photograph on a flat ferrous metal surface, the framing system comprising:

a top mount mat having a front surface, an opposite rear surface, and at least one centrally-located aperture;

adhesion means for attachment to the rear surface and over the aperture;

a flat, flexible, U-shaped, transparent centering tool including grid lines and indicia peripherally arranged about the grid lines whereby the centering tool can be temporarily laid upon the front surface of the top mount mat and a photograph can then be laid upon the centering tool and over the aperture in order to use the grid lines and indicia for centering the photograph on the top mount mat whereupon the photograph could be pressed through the aperture and against the adhesion means and then the centering tool can be removed therefrom;

a photograph holder having opposed flat sheets attached to each other along three edges so that at least one opening is formed for enabling both the mat and the photograph to be removably inserted through the opening and into the holder; and a flat, magnetic sheet having an adhesive front surface for attachment to one of the flat sheets of the photograph holder, and an opposite magnetized rear surface for removable securement to the ferrous metal surface.

3. A method of assembling a picture framing system for attachment to a ferrous metal surface, a non-ferrous metal surface, or a non-metal surface which comprises the steps of:

(1) Providing a photograph;

providing a top mount mat having a front surface, an opposite rear surface, and at least one centrally-located aperture;

providing adhesion means attached to the rear surface and over the aperture;

providing a flat, U-shaped centering tool having a front work surface, grid lines extending on the front work surface, and indicia arranged about the periphery of the front work surface so that the photograph can be arranged and centered on the top mount mat by using the grid lines and indicia of the centering tool;

providing a photograph holder having at least one opening for receiving and holding therein both the mat and the photograph;

providing a magnetic sheet having an adhesive front surface for adhesion to the photograph holder and an opposite magnetized rear surface; and providing a flat, ferromagnetic sheet having a front magnetically attractive surface for attachment to the magnetized rear surface of the magnetic sheet and an opposite rear adhesive surface for removable securement to the ferrous metal surface, non-ferrous metal surface, and the non-metal surface;

(2) Peeling a covering off the front surface of the top mount mat thereby exposing the adhesion means through the aperture;

(3) Placing the centering tool on the top mount mat and using the indicia and grid lines as guides for properly aligning the centering tool on the top mount mat;

(4) Superposing the photograph adjacent the centering tool whereby the indicia and grid lines of the centering tool are used to properly align the photograph above the top mount mat;

(5) Pressing the photograph against the top mount mat so that the photograph contacts the adhesion means and is thereby securably fixed to the top mount mat;

(6) Removing the centering tool by sliding the centering tool out from its temporary placement between the top mount mat and the photograph; and (7) Inserting the top mount mat and the photograph adhered thereto through the opening of the photograph holder for containment therein.

* * * * *